US007694617B2

(12) United States Patent
Habra et al.

(10) Patent No.: US 7,694,617 B2
(45) Date of Patent: Apr. 13, 2010

(54) GIFT WRAP PAPER CUTTER

(76) Inventors: Henry Habra, 1779 Sunningdale Dr., Roseville, CA (US) 95747; Jody L. Habra, 1779 Sunningdale Dr., Roseville, CA (US) 95747

( * ) Notice: Subject to any disclaimer, the term of this patent is extended or adjusted under 35 U.S.C. 154(b) by 314 days.

(21) Appl. No.: 12/019,266

(22) Filed: Jan. 24, 2008

(65) Prior Publication Data

US 2009/0188366 A1 Jul. 30, 2009

(51) Int. Cl.
*B26D 1/04* (2006.01)

(52) U.S. Cl. ..... 83/578; 83/614; 83/649

(58) Field of Classification Search ..... 83/578, 83/614, 649, 650
See application file for complete search history.

(56) References Cited

U.S. PATENT DOCUMENTS

| | | | | | |
|---|---|---|---|---|---|
| 1,909,780 | A | * | 5/1933 | McCann | 30/293 |
| 1,996,224 | A | * | 4/1935 | Wedekind | 83/578 |
| 2,633,196 | A | * | 3/1953 | Taran | 83/578 |
| 2,672,933 | A | * | 3/1954 | Bridy | 83/578 |
| 2,823,969 | A | * | 2/1958 | Traver et al. | 83/454 |
| 3,108,349 | A | * | 10/1963 | Takacs | 83/437.1 |
| 3,173,591 | A | | 3/1965 | Sax et al. | |
| 3,199,109 | A | * | 8/1965 | Battaglini et al. | 346/24 |
| 3,236,427 | A | * | 2/1966 | Martin | 225/96 |
| 3,290,978 | A | * | 12/1966 | Battaglini et al. | 83/578 |
| 3,370,497 | A | * | 2/1968 | Busse | 83/455 |
| 4,156,382 | A | * | 5/1979 | Baker | 493/86 |
| 4,201,104 | A | * | 5/1980 | Insolio | 83/886 |
| D300,492 | S | | 4/1989 | Pearce | |
| 4,871,156 | A | * | 10/1989 | Kozyrski et al. | 269/303 |
| 5,269,212 | A | * | 12/1993 | Peters et al. | 83/455 |
| 5,272,947 | A | * | 12/1993 | Peters | 83/455 |
| 5,480,080 | A | | 1/1996 | Ferguson | |
| 5,603,253 | A | * | 2/1997 | Logan | 83/875 |
| 5,732,868 | A | | 3/1998 | Gammon, Jr. | |
| 5,850,960 | A | | 12/1998 | Cadwell | |
| 6,138,546 | A | * | 10/2000 | Hursey | 83/875 |
| 6,491,198 | B1 | | 12/2002 | Frank | |
| 7,111,727 | B2 | | 9/2006 | Small et al. | |
| 2003/0140760 | A1 | * | 7/2003 | Bory | 83/614 |
| 2003/0178462 | A1 | | 9/2003 | Huang | |
| 2004/0007606 | A1 | | 1/2004 | Baker, Jr. | |
| 2004/0089691 | A1 | | 5/2004 | Gerulski | |

* cited by examiner

*Primary Examiner*—Kenneth E. Peterson
(74) *Attorney, Agent, or Firm*—Crossley Patent Law; Mark A. Crossley

(57) ABSTRACT

A gift wrap paper cutter that is used to both store a tube of gift wrap and also to cut off a desired length of gift wrapping from the tube. The cutter comprises an outer casing that has a track running lengthwise within the outer casing. Within the track is a razor blade that is axially mounted within a movable casing that can be slid back and forth lengthwise along the track. A pair of springs are attached to the axle, ensuring that the razor blade, in its default position, is located above a length of gift wrap paper and does not cut the paper. However, an individual can push down on a handle attached to the razor blade, causing one of the ends of the razor blade to be pushed into the length of gift wrap paper, allowing the individual to cut the gift wrap paper lengthwise.

4 Claims, 5 Drawing Sheets

GIFT WRAP PAPER CUTTER

BACKGROUND OF THE INVENTION

The present invention concerns that of a new and improved gift wrap paper cutter that is used to both store a tube of gift wrap and also to cut off a desired length of gift wrapping from the tube.

SUMMARY OF THE INVENTION

The present invention concerns that of a new and improved gift wrap paper cutter that is used to both store a tube of gift wrap and also to cut off a desired length of gift wrapping from the tube. The cutter comprises an outer casing that has a track running lengthwise within the outer casing. Within the track is a razor blade that is axially mounted within a movable casing that can be slid back and forth lengthwise along the track. A pair of springs are attached to the axle, ensuring that the razor blade, in its default position, is located above a length of gift wrap paper and does not cut the paper. However, an individual can push down on a handle attached to the razor blade, causing one of the ends of the razor blade to be pushed into the length of gift wrap paper, allowing the individual to cut the gift wrap paper lengthwise. The pair of springs cause the razor blade to disengage from the gift wrap paper when downward pressure is no longer applied to the handle attached to the razor blade.

There has thus been outlined, rather broadly, the more important features of a gift wrap paper cutter that the detailed description thereof that follows may be better understood and in order that the present contribution to the art may be better appreciated. There are, of course, additional features of the gift wrap paper cutter that will be described hereinafter and which will form the subject matter of the claims appended hereto.

In this respect, before explaining at least one embodiment of the gift wrap paper cutter in detail, it is to be understood that the gift wrap paper cutter is not limited in its application to the details of construction and to the arrangements of the components set forth in the following description or illustrated in the drawings. The gift wrap paper cutter is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present gift wrap paper cutter. It is important, therefore, that the claims be regarded as including such equivalent constructions insofar as they do not depart from the spirit and scope of the present invention.

It is therefore an object of the present invention to provide a gift wrap paper cutter which has all of the advantages of the prior art and none of the disadvantages.

It is another object of the present invention to provide a gift wrap paper cutter which may be easily and efficiently manufactured and marketed.

It is another object of the present invention to provide a gift wrap paper cutter which is of durable and reliable construction.

It is yet another object of the present invention to provide a gift wrap paper cutter which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
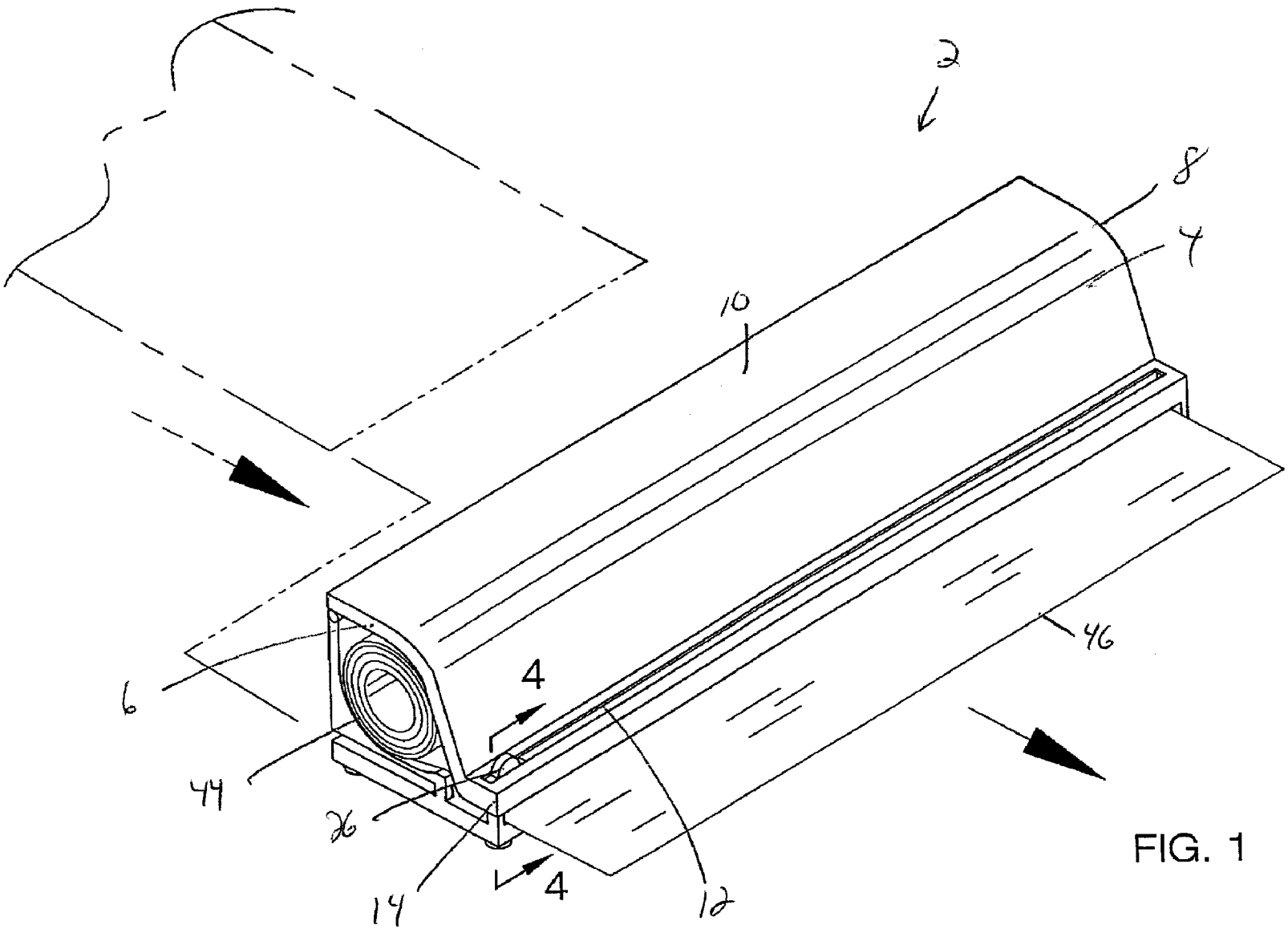
FIG. 1 shows a perspective view of the gift wrap paper cutter.
Figure 2:
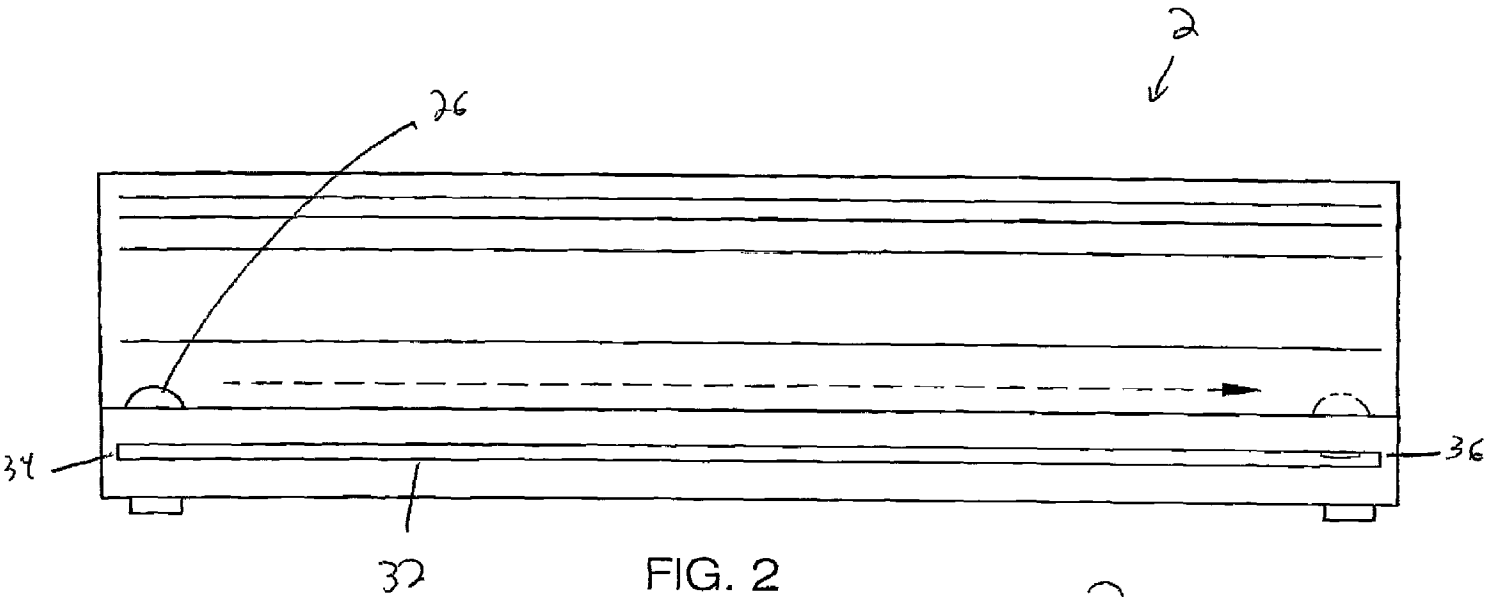
FIG. 2 shows a front view of the gift wrap paper cutter.
Figure 3:
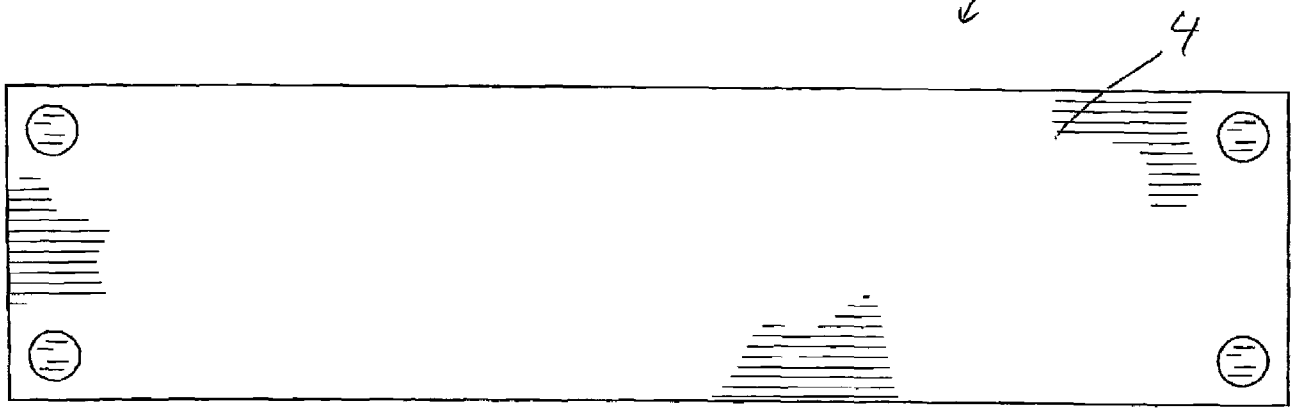
FIG. 3 shows a bottom view of the gift wrap paper cutter.
Figure 4A:
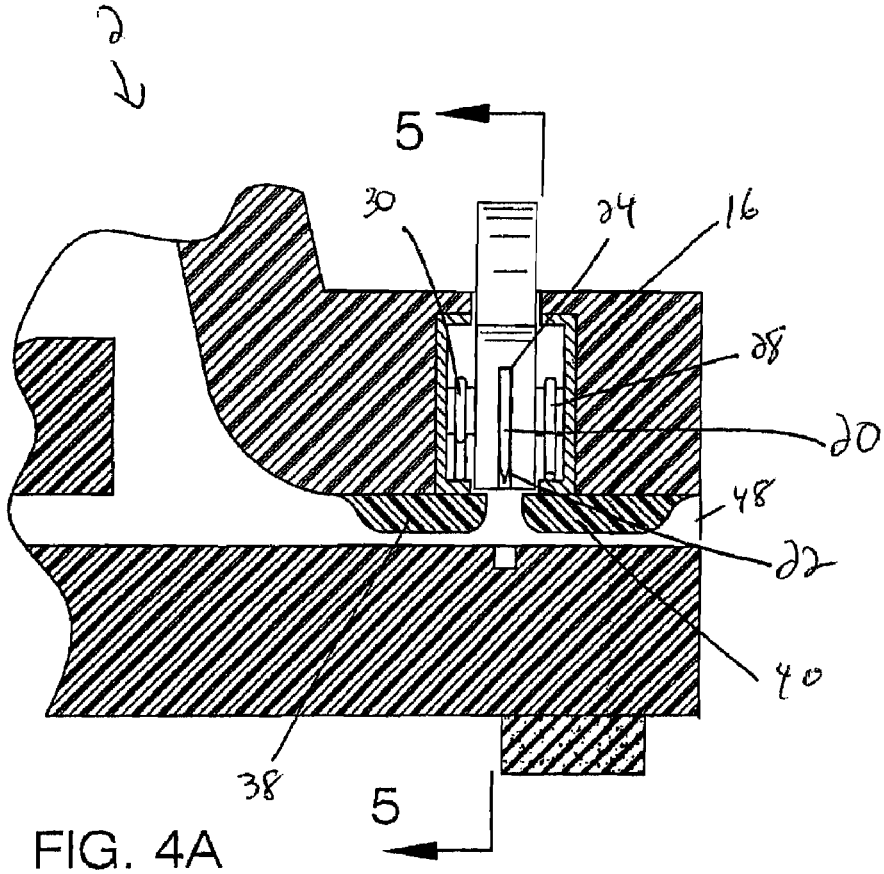
FIG. 4A shows a side cutaway view of the gift wrap paper cutter with the blade in a retracted position.
Figure 4B:
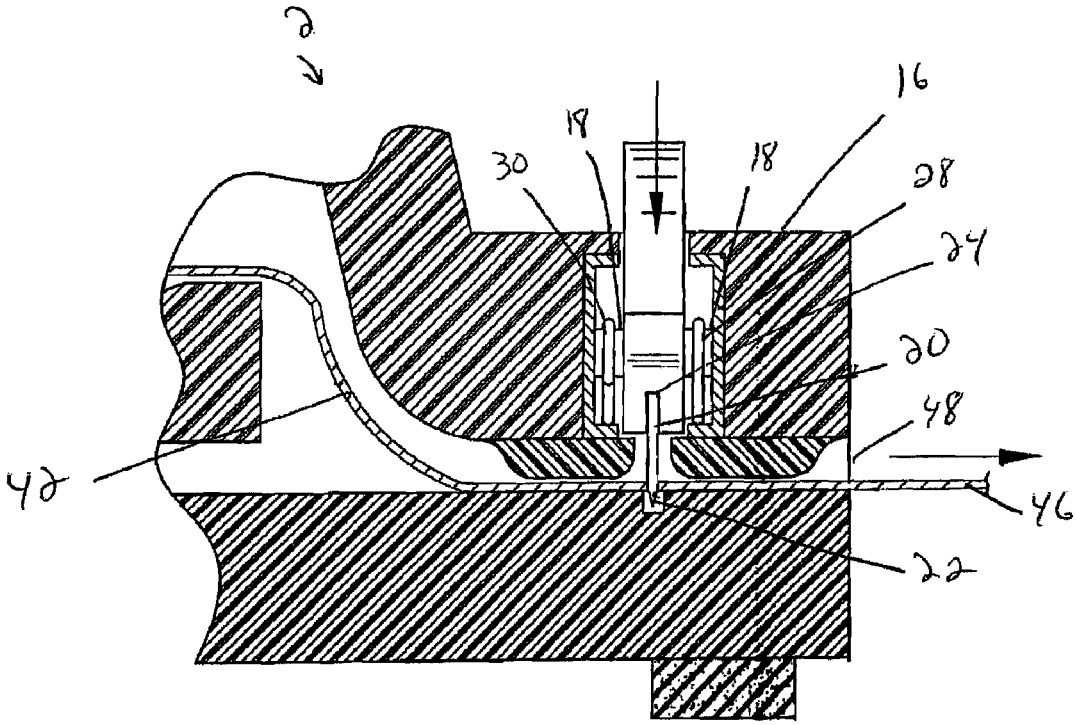
FIG. 4B shows a side cutaway view of the gift wrap paper cutter with the blade in an engaged position.
Figure 5A:
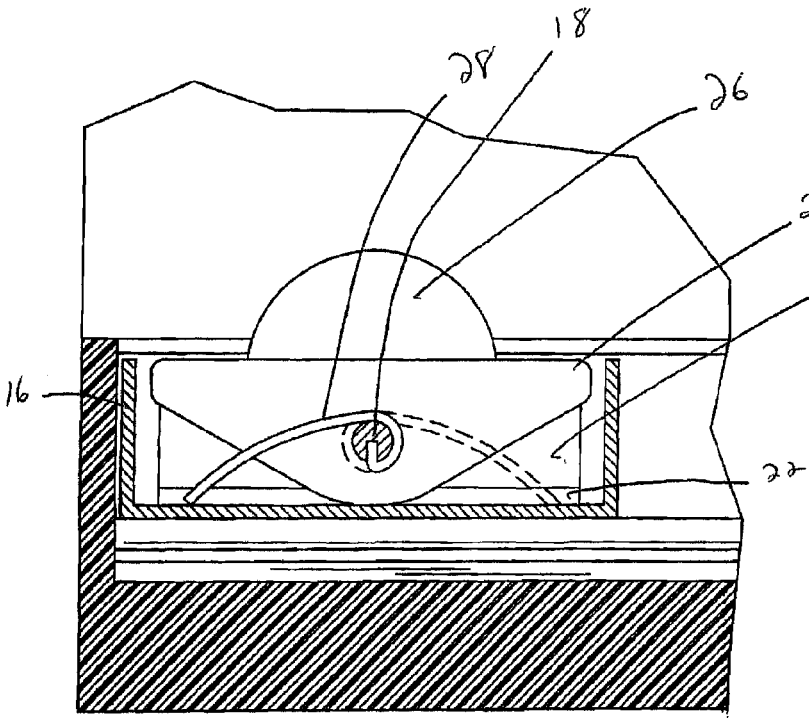
FIG. 5A shows a front cutaway view of the gift wrap paper cutter with the blade in a retracted position.
Figure 5B:
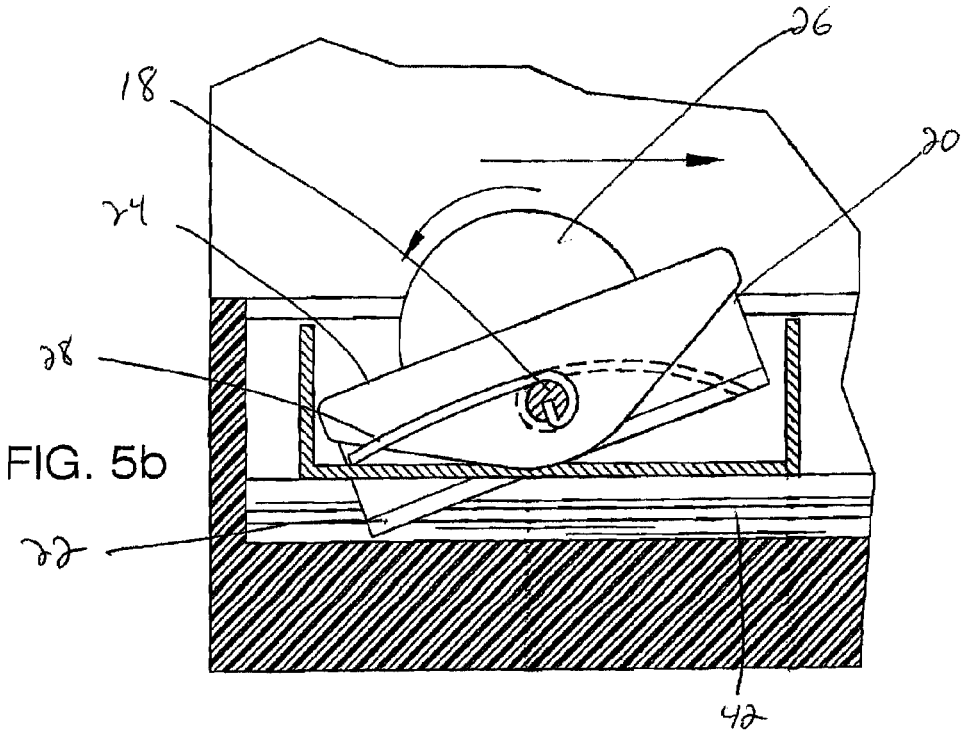
FIG. 5B shows a front cutaway view of the gift wrap paper cutter with the blade in an engaged position.
Figure 6:
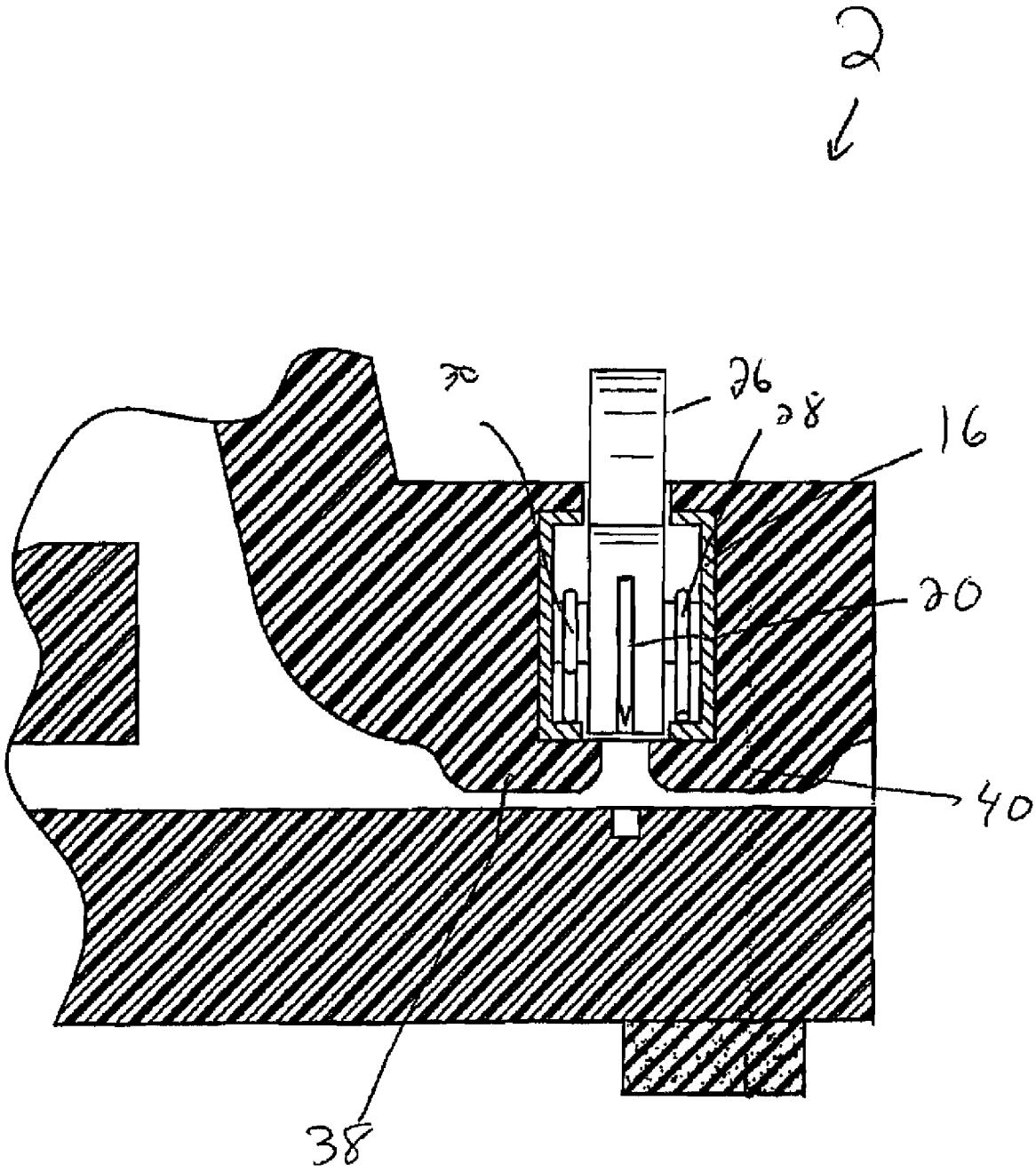
FIG. 6 shows a side cutaway view of an alternative embodiment of the gift wrap paper cutter with the blade in a retracted position.

With reference now to the drawings, and in particular to FIGS. 1 through 6 thereof, a gift wrap paper cutter embodying the principles and concepts of the present invention and generally designated by the reference numeral 2 will be described.

As best illustrated in FIGS. 1 through 6, the gift wrap paper cutter 2 comprises an outer casing 4 that has two ends comprising a first end 6 and a second end 8. The majority of the outer casing 4 comprises a housing 10 that has both of its ends open. A track 12 is attached to a small recessed platform 14 that is connected to the housing 10.

A movable casing 16 is located within the track 12, with the movable casing 16 having an axle 18 within it. A razor blade 20 is axially mounted on the axle 18, with the blade side 22 of the razor blade 20 facing downward and the handle end 24 of the razor blade 20 facing upward. A circular handle 26 is attached to the handle end 24 of the razor blade 20. The razor blade has two ends comprising a first end and a second end, with the razor blade, in its retracted position, being parallel with the track 12.

A pair of springs 28 and 30 are located within the movable casing 16, with each of the springs 28 and 30 axially surrounding the axle 18. The springs 28 and 30 are attached to the razor blade 20 and are located on either side of the razor blade 20. Each of the springs has two ends comprising a first end and a second end, with the ends of both of the springs 28 and 30 being flush with the bottom of the movable casing 16.

The area within the housing 10 is connected to a slot 32 that runs underneath the track 12. The slot 32 runs along most of the length of the outer casing 4, only allowing for two supports 34 and 36 to help it to be mounted. The track 12 is contiguous with the slot 32. A pair of support pads 38 and 40 are located within the slot 32 and are attached to the bottom of the movable casing 16.

When an individual wishes to cut a length of gift wrap paper 42, he or she must first put a roll of gift wrap paper 44 within the housing 10 of the cutter 2. Then, the leading edge 46 of the gift wrap paper 44 will be pulled away and through the slot 32 and through an opening 48. Once the leading edge 46 of the gift wrap paper 44 has been pulled through the opening 48 to a length that an individual desires, he or she can press down on the circular handle 26, causing an end of the razor blade 20 to pass down through the gift wrap paper 44 and into a groove located within the slot 32. In this position, an individual merely needs to move the razor blade 20 back and forth along the entire length of the track 12, which will cause a length of gift wrap paper 42 to be separated from the roll of gift wrap paper 44. The support pads 38 and 40 are pushed against the gift wrap paper, helping to hold it in place while it being cut. An individual can then remove the cut piece of gift wrap paper 42 and utilize it as needed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and 11 described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A gift wrap paper cutter comprising (a) an outer casing, the outer casing having two ends comprising a first end and a second end, (b) a housing incorporated into the outer casing, (c) a recessed platform connected to the housing, (d) a track attached to the recessed platform, (e) an amount of gift wrap paper inserted into the housing, (f) means for connecting the housing to the track, and (g) means for cutting off a length of gift wrap paper pulled away from the amount of gift wrap paper inserted into the housing, wherein the means for connecting the housing to the track further comprises (h) a slot located within the outer casing, wherein the slot runs underneath the track, further wherein the slot runs along most of the length of the outer casing, and (i) a pair of supports located within the slot, wherein the means for cutting off a length of gift wrap paper further comprises (j) a movable casing located within the track, (k) a razor blade mounted within the movable casing, the razor blade having two sides comprising a handle side and a blade side, the razor blade also having two ends comprising a first end and a second end, (l) means for grasping the handle end of the razor blade, (m) means for altering the position of the razor blade to allow it to cut a length of gift wrap paper that has been pulled away from the amount of gift wrap paper inserted into the housing and pulled through the slot located within the outer casing, thereby placing the length of gift wrap paper underneath the track, (n) means for providing a tension upon the razor blade in a moved position to force the razor blade back into a default position, wherein the movable casing further comprises;

(o) an axle mounted within the movable casing, (p) wherein the razor blade is axially mounted upon the axle, (q) further wherein the blade side of the razor blade faces downward and the handle end of the razor blade faces upward, (r) further wherein the blade rests in a position parallel to that of the track when the blade is not in use, wherein the means for grasping the handle end of the razor blade further comprises;

(s) an added handle attached to the handle end of the razor blade, (t) wherein the added handle has a convex semi-circular shape, wherein the means for altering the position of the razor blade further comprises;

(u) a pair of springs comprising a first spring and a second spring, each of said springs having two ends comprising a first end and a second end, the pair of springs being located within the movable casing, wherein the pair of springs are attached to the razor blade, further wherein the pair of springs are located on either side of the razor blade in relation to each other, (v) wherein the ends of each of the springs are flush with the bottom of the movable casing, (w) wherein an individual can grasp the circular handle attached to the handle end of the razor blade and push down one of the ends of the razor blade and subsequently run the movable casing lengthwise along the track, thereby cutting off the extended length of gift paper from the amount of gift wrap paper inserted into the housing.

2. A gift wrap paper cutter according to claim 1 wherein means for providing a tension upon the razor blade in a moved position to force the razor blade back into a default position further comprises (a) an amount of tension incorporated into each spring of the pair of springs, (b) wherein altering the position of the razor blade in relation to its parallel position to the track causes tension to build up within each spring of the pair of springs, (c) further wherein the tension within each spring of the pair of springs will cause the razor blade to be forced back into a parallel position in relation to the track once te razor blade is not being grasped by an individual.

3. A gift wrap paper cutter according to claim 2 wherein the gift wrap paper cutter further comprises means for holding the extended length of gift paper of the amount of gift wrap paper in place when the razor is being used to cut the extended length of gift paper, said means further comprising (a) a pair of support pads located within the slot, the pair of support pads comprising a first support pad and a second support pad, (b) wherein the pair of support pads help to hold the positioning of the extended length of gift paper after it has been inserted through the slot located within the outer casing.

4. A gift wrap paper cutter comprising (a) an outer casing, the outer casing having two ends comprising a first end and a second end, (b) a housing incorporated into the outer casing, (c) a recessed platform connected to the housing, (d) a track attached to the recessed platform, (e) an amount of gift wrap paper inserted into the housing, (f) means for connecting the housing to the track, said means for connecting further comprising (i) a slot located within the outer casing, wherein the slot runs underneath the track, further wherein the slot runs along most of the length of the outer casing, and (ii) a pair of supports located within the slot, and (g) means for cutting off a length of gift wrap paper pulled away from the amount of gift wrap paper inserted into the housing, said means for cutting further comprising (i) a movable casing located within the track, the movable casing further comprising (1) an axle mounted within the movable casing, (2) wherein the razor blade is axially mounted upon the axle, (3) further wherein the blade side of the razor blade faces downward and the handle end of the razor blade faces upward, (4) further wherein the blade rests in a position parallel to that of the track when the blade is not in use, (ii) a razor blade mounted within the movable casing, the razor blade having two sides comprising a handle side and a blade side, the razor blade also having two ends comprising a first end and a second end, (iii) means for grasping the handle end of the razor blade, said means for grasping further comprising (1) an added handle attached to the handle end of the razor blade, (2) wherein the added handle has a convex semi-circular shape, (iv) means for altering the position of the razor blade to allow it to cut a length of gift wrap paper that has been pulled away from the amount of gift wrap paper inserted into the housing and pulled through the slot located within the outer casing, thereby placing the length of gift wrap paper underneath the track, said means for altering further comprising (1) a pair of springs comprising a first spring and a second spring, each of said springs having two ends comprising a first end and a second end, the pair of springs being located within the movable casing, wherein the pair of springs are attached to the razor blade, further wherein the pair of springs are located on either side of the razor blade in relation to each other, (2) wherein the ends of each of the springs are flush with the bottom of the movable casing, (3) wherein an individual can grasp the circular handle attached to the handle end of the razor blade and push down one of the ends of the razor blade and subsequently run the movable casing lengthwise along the track, thereby cutting off the extended length of gift paper from the amount of gift wrap paper inserted into the housing, and (v) means for providing a tension upon the razor blade in a moved position to force the razor blade back into a default position, said means for providing further comprising (1) an amount of tension incorporated into each spring of the pair of springs, (2) wherein altering the position of the razor blade in relation to its parallel position to the track causes tension to build up within each spring of the pair of springs, (3) further wherein the tension within each spring of the pair of springs will cause the razor blade to be forced back into a parallel position in relation to the track once the razor blade is not being grasped by an individual, (h) means for holding the extended length of gift paper of the amount of gift wrap paper in place when the razor is being used to cut the extended length of gift paper, said means for holding further comprising (i) a pair of support pads located within the slot, the pair of support pads comprising a first support pad and a second support pad, (ii) wherein the pair of support pads help to hold the positioning of the extended length of gift paper after it has been inserted through the slot located within the outer casing.

* * * * *